US006877448B2

(12) United States Patent
Lonati et al.

(10) Patent No.: US 6,877,448 B2
(45) Date of Patent: Apr. 12, 2005

(54) SEWING METHOD AND APPARATUS FOR CLOSING AN AXIAL END OF TUBULAR ARTICLE

(75) Inventors: Ettore Lonati, Brescia (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 77 days.

(21) Appl. No.: 10/625,663

(22) Filed: Jul. 24, 2003

(65) Prior Publication Data

US 2004/0020416 A1 Feb. 5, 2004

(30) Foreign Application Priority Data

Aug. 1, 2002 (IT) ..... MI2002A1736

(51) Int. Cl.[7] ..... D05B 27/00; D05B 33/00

(52) U.S. Cl. ..... 112/475.12; 112/470.15

(58) Field of Search ..... 112/475.12, 470.15, 112/470.29, 470.33, 303, 304, 311, 318, 322, 217, 475.01, 475.03, 475.09, 475.17; 66/179, 178 A

(56) References Cited

U.S. PATENT DOCUMENTS

| | | | | | |
|---|---|---|---|---|---|
| 3,452,691 | A | * | 7/1969 | Gunter | 112/2 |
| 3,527,181 | A | * | 9/1970 | Beamon | 112/27 |
| 4,957,051 | A | * | 9/1990 | Maegawa et al. | 112/470.08 |
| 5,398,626 | A | * | 3/1995 | Rosso et al. | 112/470.15 |
| 6,158,254 | A | * | 12/2000 | Richard | 66/179 |
| 6,283,055 | B1 | * | 9/2001 | Salvetti | 112/470.15 |

* cited by examiner

*Primary Examiner*—Ismael Izaguirre
(74) *Attorney, Agent, or Firm*—Guido Modiano; Albert Josif; Daniel O'Byrne

(57) ABSTRACT

A sewing method and apparatus, for closing the axial end of a tubular article, such as a hosiery toe, consisting in moving the article along a guiding path, formed by two adjacent laminas faced by a sewing head, in two opposite directions so as to make the article advance with respect to the sewing head during formation of a first stitched seam, retracting the article to return upstream of the sewing head after formation of the first stitched seam, and make the article advance again during formation of the second stitched seam, to close the article by two sewing lines, using a single sewing head.

14 Claims, 7 Drawing Sheets

SEWING METHOD AND APPARATUS FOR CLOSING AN AXIAL END OF TUBULAR ARTICLE

BACKGROUND OF THE INVENTION

The present invention relates to a sewing method and apparatus, particularly for closing the toe of hosiery items or an axial end of tubular articles in general.

U.S. Ser. No. 10/459,526 by the same Applicant discloses a double-cylinder circular hosiery knitting machine that is provided with a device that is capable of picking and transferring the article at the end of the knitting process, particularly for automating the closure of the toe of hosiery items.

According to the teachings provided by this patent application, to which reference is made for completeness of exposition, the articles, particularly a hosiery item, at the end of its production by means of a double-cylinder circular hosiery knitting machine, is extracted upward from the upper needle cylinder and its axial end or toe is flattened and inserted between the pair of substantially horizontal guiding laminas that are arranged at the inlet of a sewing machine that closes the article.

The sewing machines currently used for this operation are generally provided with two sewing heads, which are arranged sequentially along the advancement path of the article.

Each one of these sewing heads is capable of performing an overcast-stitch seam by means of a curved needle and a crochet, and the two heads are arranged generally at different heights each other so as to close the end of the articles by means of two rows of stitches that are slightly spaced from each other.

Currently commercially available sewing machines of this type are meant for mass-production with very short sewing times. For this reason, the cost of these machines is relatively high and in any case does not make it financially convenient to use a machine of this kind to serve a hosiery knitting machine.

SUMMARY OF THE INVENTION

The aim of the present invention is to provide a sewing method, particularly for closing the toe of hosiery items or an axial end of tubular articles in general, that allows to simplify the apparatus required for this operation and therefore allows to contain the associated production costs.

Within this aim, an object of the invention is to provide a sewing method that allows to produce stitched seams that are aesthetically and structurally comparable to those obtainable with currently commercially available sewing machines.

Another object of the invention is to provide an apparatus for carrying out the method according to the invention that thanks to its simplicity and low manufacturing cost can be used in a financially convenient manner to serve a hosiery knitting machine, particularly for closing the toe of hosiery items manufactured by the same machine.

Another object of the invention is to provide an apparatus that is highly reliable and accurate in operation.

This aim and these and other objects that will become better apparent hereinafter are achieved by a sewing method, particularly for closing the toe of hosiery items or an axial end of tubular articles in general, characterized in that it comprises the following steps:

flattening the end of the article to be sewn by moving close to each other the two opposite flaps of said end of the article;

inserting said end of the article between two mutually facing laminas that form a passage that constitutes at least the initial part of a guiding path for said end of the article, so that the article protrudes with a portion of said end from a side of said pair of laminas;

producing the advancement of the article along said guiding path;

performing a first sewing of said end by means of a sewing head arranged proximate to said guiding path while the article advances along said guiding path;

disengaging the sewing head from the article and retracting the article along said guiding path until the article returns upstream of the sewing head;

again producing the advancement of the article along said guiding path;

performing a second sewing of said end of the article by way of the same sewing head, while the article advances along said guiding path;

disengaging the article from the sewing head.

The method according to the invention is preferably performed by means of a sewing apparatus, particularly for closing the toe of hosiery items or an axial end of tubular articles in general, which comprises: two mutually facing laminas that form a passage between them, said passage constituting at least the initial part of a guiding path and being suitable to receive a region of the article that lies proximate to the end to be sewn, at least one sewing head that faces the side of the plane of arrangement of said pair of laminas from which a portion of the end of the article to be sewn is meant to protrude, characterized in that it comprises means for moving the article along said guiding path in two opposite directions of motion so as to make the article advance with respect to the sewing head during the forming of a first stitched seam, in order to make the article retract until it lies upstream of the sewing head after the forming of the first stitched seam and to make the article advance again during the forming of a second stitched seam.

BRIEF DESCRIPTION OF THE DRAWINGS

Further characteristics and advantages of the invention will become better apparent from the description of a preferred but not exclusive embodiment of the method according to the invention and of the apparatus for performing it, illustrated by way of non-limitative example in the accompanying drawings, wherein.

DESCRIPTION OF THE PREFERRED EMBODIMENTS

Figure 1:
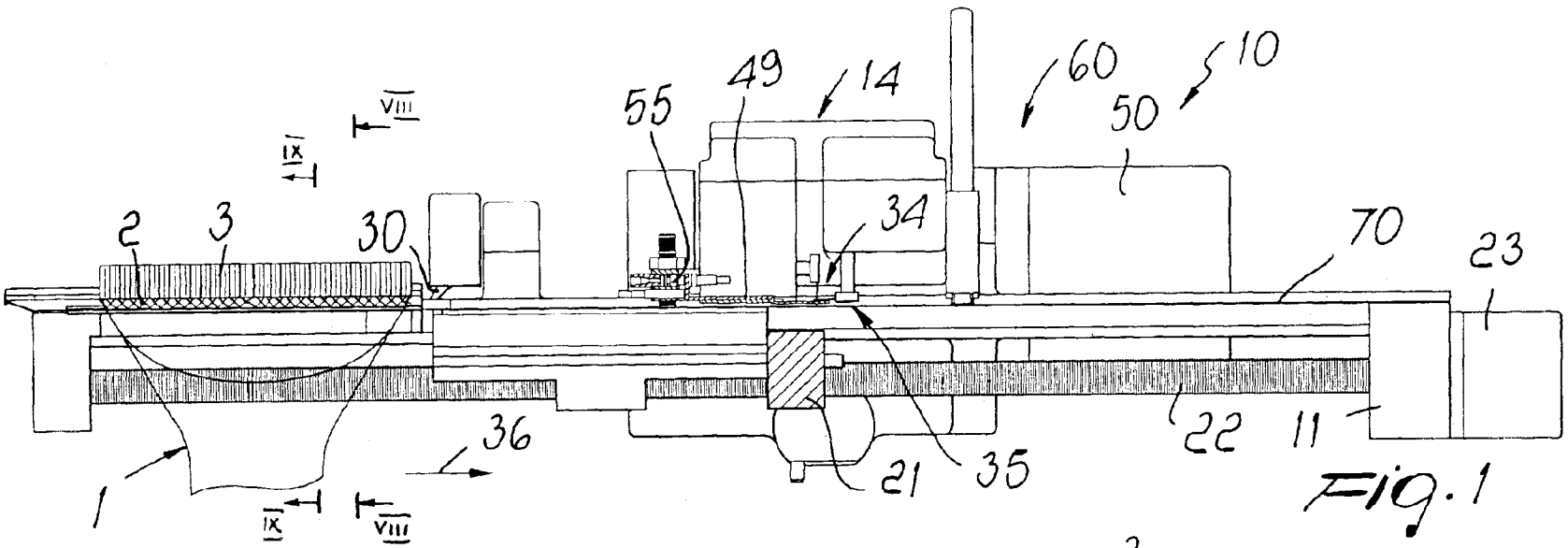
FIGS. 1 to 7 are sequential views of steps of the method according to the invention, with the apparatus shown in a partially sectional schematic front elevation view.
Figure 8:
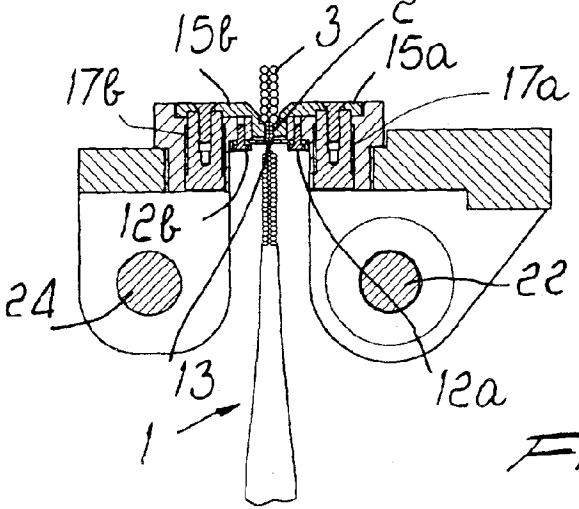
FIG. 8 is a schematic enlarged-scale sectional view of FIG. 1, taken along the line VIII—VIII.

The method according to the invention and the apparatus for performing it are described for the sake of simplicity with reference to the production of the stitched seam for closing the toe of a hosiery item, without altering the fact that the method and the apparatus according to the invention can be used to perform more generally the closure, by way of a stitched seam, of an axial end of a tubular article.

The hosiery item, whose toe is meant to be closed by sewing, generally designated by the reference numeral 1, is preferably provided so as to simplify said stitching operation and make it particularly accurate. More particularly, the part of the toe that is formed last in the production cycle of the hosiery item is produced by means of a few rows 2 formed with a thinner and preferably elastic thread, such as for example helanca, so as to provide a region that has a reduced thickness. These rows 2 are followed by a few rows 3 made of a thread that has a significantly larger diameter, so as to obtain an end border of the hosiery item that is thicker than the region formed by means of the rows 2.

The enlarged border 3, as well as the rows 2, are an additional part for the actual hosiery item, and said additional part is meant to be used exclusively to facilitate and increase the precision of the positioning of the hosiery item 1 on the sewing apparatus and is meant to be removed just before the forming of the stitched seam, as will become better apparent hereinafter.

The apparatus for performing the method according to the invention, generally designated by the reference numeral 10, comprises a supporting structure 11, which is shown only partially for the sake of simplicity and supports two laminas 12*a* and 12*b*, which face each other, preferably on a substantially horizontal plane, so as to form between them a passage 13 that is adapted to receive a region of the hosiery item or article 1 that lies proximate to the end to be sewn. Said region of the article 1 is constituted by the region formed by the rows 2, i.e., by the region of the thinner additional part that is adjacent to the actual hosiery item, which is thicker.

The laminas 12*a* and 12*b* form the passage 13 that constitutes the initial portion of a substantially straight and horizontal guiding path 70 for the hosiery item, and along said path there is a sewing head 14 that faces, in an upward region, the plane of arrangement of the pair of laminas 12*a* and 12*b*.

In practice, the hosiery item 1 will be arranged with its toe between the pair of laminas 12*a* and 12*b*, as described, so as to lie on a substantially vertical plane with the remaining part of the hosiery item that protrudes downward from the pair of laminas 12*a* and 12*b*, while the enlarged border 3 and substantially all of the region constituted by the rows 2 protrudes upward from the pair of laminas 12*a* and 12*b*, i.e., toward the sewing head 14.

The sewing head 14 is constituted by a sewing head with a curved needle 34 and a crochet 35, capable of forming a seam with overcast stitches.

The apparatus comprises means for moving the article 1, particularly the hosiery item 1, along said guiding path 70 in two directions of motion that are mutually opposite so as to make the article 1 advance with respect to the sewing head 14 during the forming of a first stitched seam, make the article 1 retract until it lies upstream of the sewing head 14 after the forming of the first stitched seam, and make the article 1 advance again during the forming of a second stitched seam.

Furthermore, advantageously, the apparatus comprises means for varying the distance of the sewing head 14 from the pair of laminas 12*a* and 12*b* so as to vary the position of the line of stitches on the article 1. Essentially, the sewing head 14 can move on command, i.e. upon receival of a motion command, so as to vary its height with respect to the pair of laminas 12*a* and 12*b* in order to form stitched seams at mutually different heights, as will become better apparent hereinafter.

More particularly, the laminas 12*a* and 12*b* form, with their lower face, a supporting surface for the beginning of the actual hosiery item, i.e., the region of the hosiery item that is adjacent to the region formed by the thinner rows 2.

Above the laminas 12*a* and 12*b* there are positioning means that can engage the end of the article 1, more particularly the enlarged border 3 that protrudes upward from the laminas 12*a* and 12*b*, and can move upward so as to apply to the article 1 a tension that is directed upward in order to place the beginning of the actual hosiery item against the contact surface formed by the lower face of the laminas 12*a* and 12*b*.

Said positioning means comprise two claws 15*a* and 15*b*, which are arranged respectively above the lamina 12*a* and the lamina 12*b* and can move vertically upward by way of the action of pistons 16*a* and 16*b* of hydraulic or pneumatic cylinders formed in the supporting structure 11, in contrast with the action of elastic means, for example springs 17*a* and 17*b*, which tend to keep the claws 15*a* and 15*b* downward.

The movement means comprise two claws 20*a* and 20*b* that are arranged respectively below the lamina 12*a* and below the lamina 12*b* and can engage the region of the article 1 that lies directly below the two laminas 12*a* and 12*b*. The two claws 20*a* and 20*b* can be actuated, in one direction or in the opposite direction, along the guiding path 70.

More particularly, the claws 20*a* and 20*b* are mounted on a frame 21 in which there is a female thread that mates with a threaded shaft 22, which is orientated so that its axis lies parallel to the extension of the guiding path 70 and is supported, so that it can rotate about its own axis, by the supporting structure 11. The threaded shaft 22 is connected to the output shaft of an actuation motor 23, which is preferably constituted by a variable-speed electric motor.

The frame 21 is furthermore mounted slidingly on a guide 24, which is fixed to the supporting structure 11 and is orientated parallel to the threaded shaft 22.

In practice, the actuation of the motor 23, with rotation of its output shaft in one direction or in the opposite direction, causes the rotation of the threaded shaft 22, which as a consequence of the coupling with the female thread formed in the frame 21 causes the translational motion, in one direction or in the opposite direction, of the claws 20*a* and 20*b* parallel to the extension of the guiding path 70, i.e., parallel to the longitudinal extension of the passage 13, in one direction or in the opposite direction.

The claws 20*a* and 20*b*, furthermore, can engage and disengage on command with respect to the article 1.

More particularly, the claws 20*a* and 20*b* are supported by the frame 21 so that they can slide toward or away from each other, so as to engage or disengage with respect to the article 1. The mutual spacing of the claws 20*a* and 20*b* is contrasted by springs 25*a* and 25*b* and can be obtained by way of the actuation of pistons 26*a* and 26*b* of hydraulic or pneumatic cylinders provided in said frame 21.

Upstream of the sewing head 14 along the advancement direction of the article 1 during sewing indicated by the arrow 36, there is a trimming cutter 30, which is arranged directly above the laminas 12*a* and 12*b* so as to remove the part of the article 1 that lies above the laminas 12*a* and 12*b*.

The laminas 12*a* and 12*b* end between the trimming cutter 30 and the sewing head 14. After the laminas 12*a* and 12*b*, the guiding path 70 for the article 1 can be defined by another pair of laminas 71*a* and 71*b* that are parallel to the laminas 12*a* and 12*b* but are arranged at a lower level in order to allow the intervention of the sewing head 14, or it can be defined simply by the path of the claws 20*a* and 20*b* that support and move the article 1.

The sewing head 14 is mounted on a corresponding supporting frame 32, which is pivoted to the supporting structure 11 about an axis 33, which is horizontal and substantially parallel to the extension of the guiding path 70 of the article 1. The axis 33 is conveniently spaced laterally from the region where the needle 34 and the crochet 35 act, i.e., the region that is aligned with the guiding path 70 of the article 1, so that a partial rotation of the sewing head 14 about the axis 33 causes a lifting or lowering of the part of the sewing head that supports said elements.

By virtue of the rotation of the sewing head 14 about the axis 33 it is possible to arrange the sewing head in three positions: a first active position, in which the sewing head 14 is arranged with the needle 34 and the crochet 35 at a first sewing level; a second active position, in which the sewing head 14 is arranged with the needle 34 and the crochet 35 at a lower sewing level than the one produced by the first active position; and a third inactive position, in which the sewing head 14 is raised above the article 1 so that it does not interfere with it.

These three positions are achieved by providing a hydraulic or pneumatic cylinder 40 that forms distance varying means that also act as motion means for the head, and which is orientated so that its axis lies transversely to the extension of the guiding path 70 and is provided with a piston 41 with a rack 42 that meshes with a toothed sector 43. The toothed sector 43 is rigidly coupled to the supporting frame 32 of the sewing head 14, which as mentioned is pivoted about the axis 33.

Substantially, the actuation of the piston 41 causes the partial rotation of the sewing head 14 about the axis 33 with respect to the supporting structure 11.

The differentiation of the two active positions is achieved by providing, on the sewing head 14, two locators 44*a* and 44*b*, which are optionally adjustable and are meant to engage respectively against a movable shoulder 45*a* and against a fixed shoulder 45*b* formed by the supporting structure 11. The movable shoulder 45*a* is formed on the piston 46 of an additional hydraulic or pneumatic cylinder 47 that has a vertical axis and is formed in the supporting structure 11. In practice, by actuating the piston 46 upward a stopping bearing element for the locator 44*a* is provided which keeps the sewing head 14 in the first active position. By instead lowering the piston 46, said retention shoulder 45*a* for the locator 44*a* is deactivated, and the locator 44*b* rests against the fixed shoulder 45*b*, formed on the supporting structure 11, which stops the sewing head 14 in the second active position, further down with respect to the first active position.

The sewing head 14 is further provided with a per se known hook 49, which differently from what is provided in conventional sewing machines can move on command, for example by means of a pneumatic actuator 55, in order to vary the width of the stitches of the chain-stitch. The controlled movement of the hook 49 substantially allows to form tight or loose chain stitches according to the requirements.

The needle 34 and the crochet 35 of the sewing head 14 are actuated by means of their own motor 50 for the actuation of the head 14. It should be noted that although the speeds of the first motor 50 and of the second motor 23 can be synchronized, the apparatus according to the invention allows to diversify the speed of the second motor 23 with respect to the speed of the first motor 50, so as to allow to vary the advancement speed of the article 1 with respect to the sewing speed. This allows to produce more or less tight stitches according to the requirements.

The operation of the apparatus in performing the method according to the invention is as follows.

Figure 10:
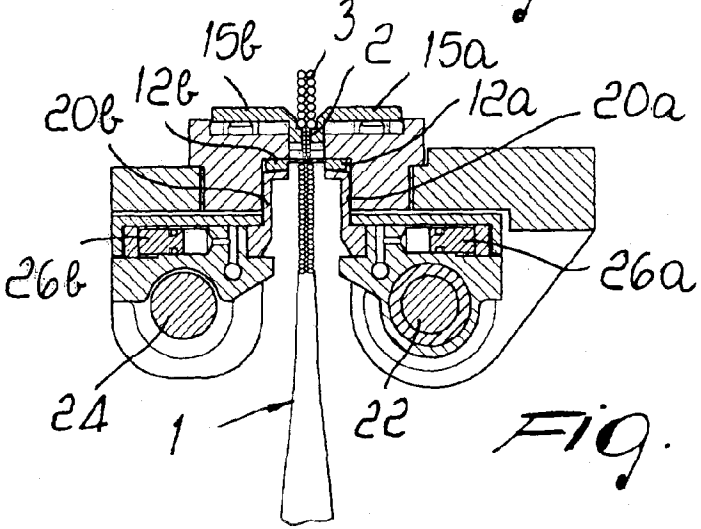
FIG. 10 is an enlarged-scale schematic sectional view of FIG. 2, taken along the line X—X.

Initially, the article 1 is inserted flat, i.e., with the opposite flaps mutually close, between the two laminas 12*a* and 12*b*, as shown in FIG. 1, while the claws 20*a* and 20*b* are mutually spaced by way of the action of the pistons 26*a* and 26*b*, as shown in particular in FIG. 10.

Figure 9:
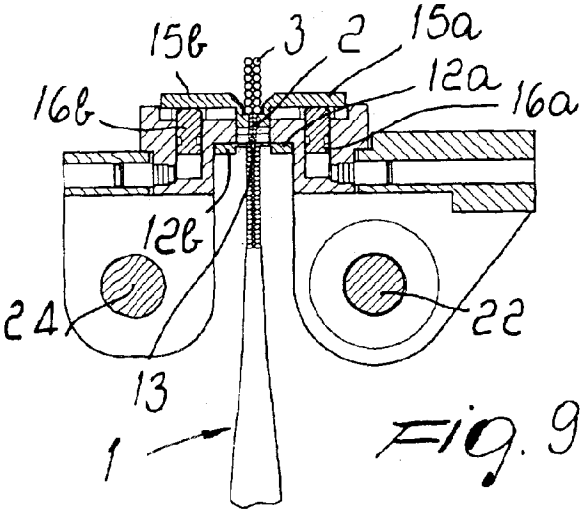
FIG. 9 is a schematic enlarged-scale sectional view of FIG. 1, taken along the line IX—IX, in an operating condition that occurs after the one shown in FIGS. 1 and 8, illustrating a precision positioning of the article with respect to the pair of laminas.
Figure 11:
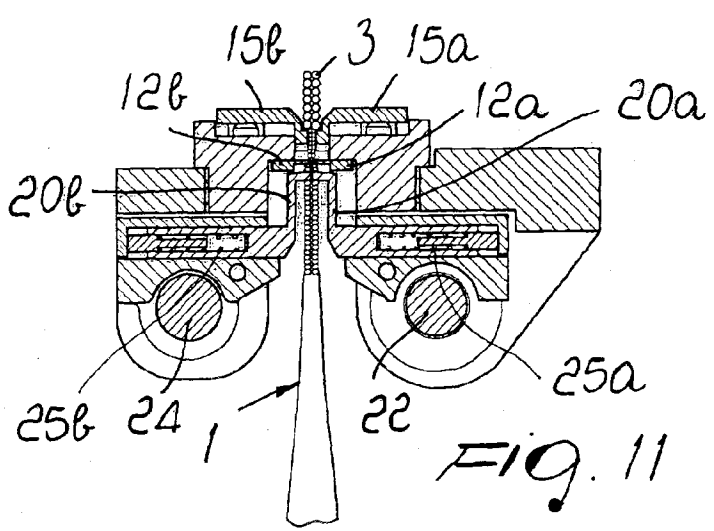
FIG. 11 is an enlarged-scale schematic sectional view of FIG. 2, taken along the line XI—XI, in an operating condition that occurs after the one shown in FIGS. 2 and 10, illustrating the engagement of the movement means with the article.

After the article 1 has been inserted between the laminas 12*a* and 12*b*, the claws 15*a* and 15*b*, by way of the actuation of the pistons 16*a* and 16*b*, are raised so as to place the beginning of the actual hosiery item against the lower face of the laminas 12*a* and 12*b*, as shown in particular in FIG. 9, and the hydraulic or pneumatic cylinders with the pistons 26*a* and 26*b* are connected to the discharge, so that the claws 20*a* and 20*b* engage the article 1 by virtue of the action of the springs 25*a* and 25*b*, as shown in FIG. 11.

Figure 2:
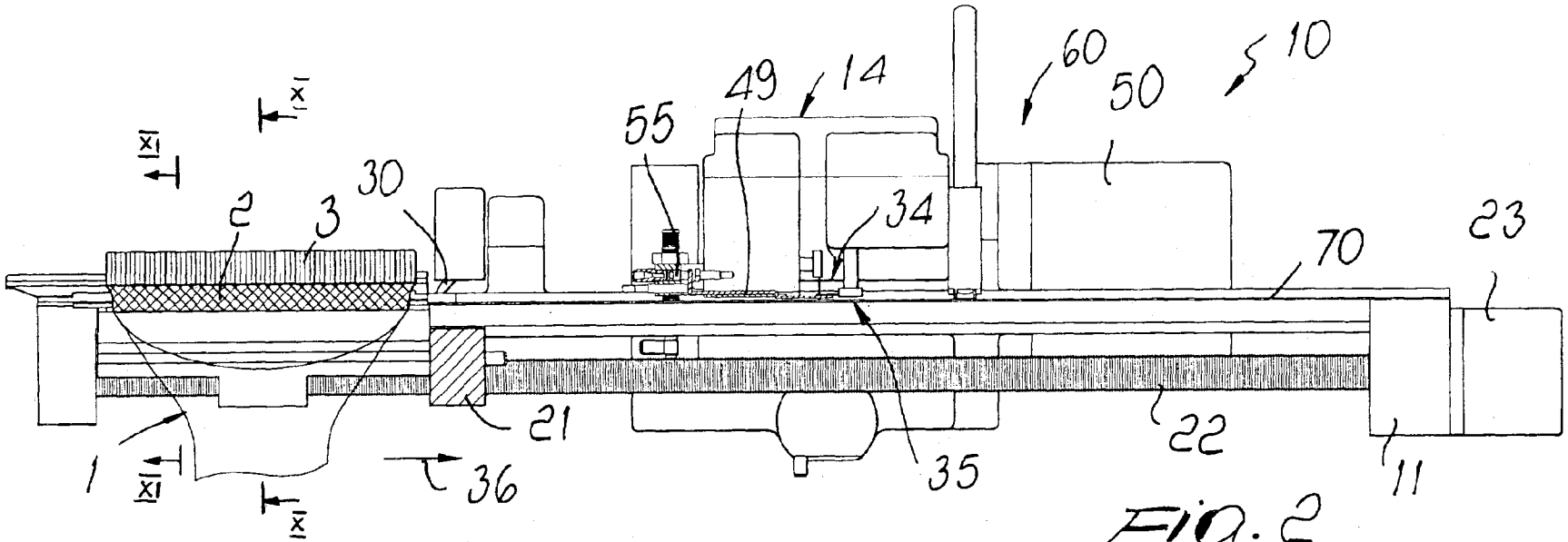
Figure 3:
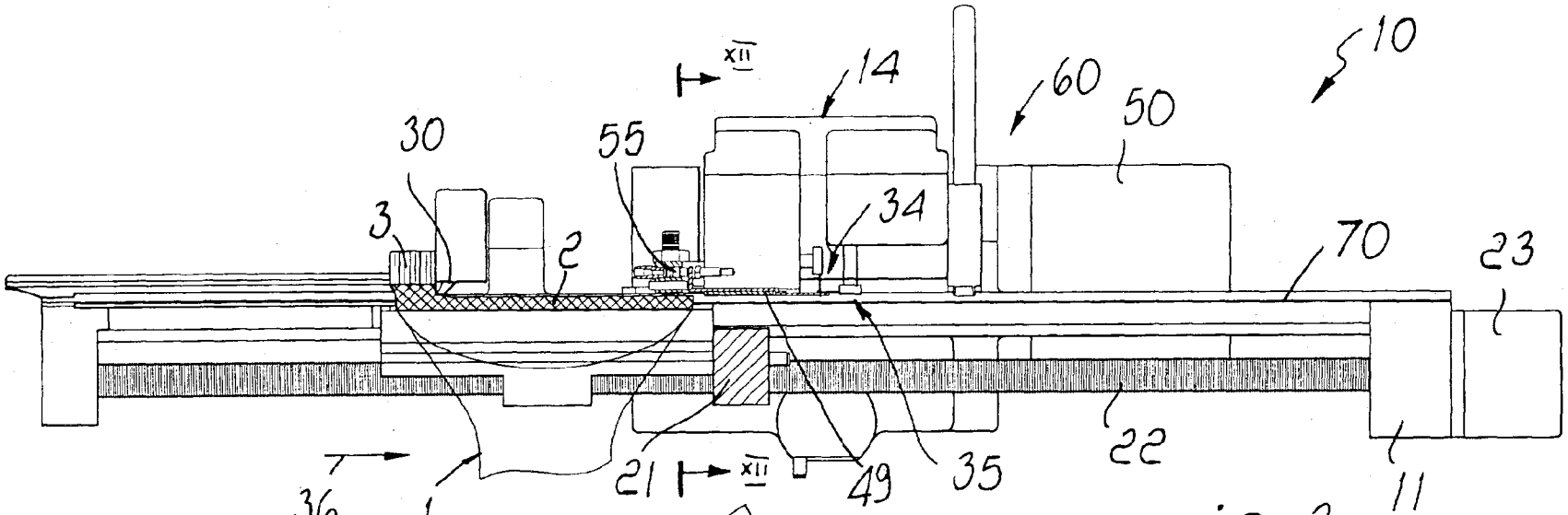

Then the motor 23 is activated, causing the advancement of the article 1, as a consequence of the translational motion of the claws 20*a* and 20*b* along the guiding path 70, toward the sewing head 14 (FIG. 2). During this advancement, the article 1 encounters the trimming cutter 30, which trims the portion of the hosiery item that protrudes upward from the laminas 12*a* and 12*b* (FIG. 3).

Figure 12:
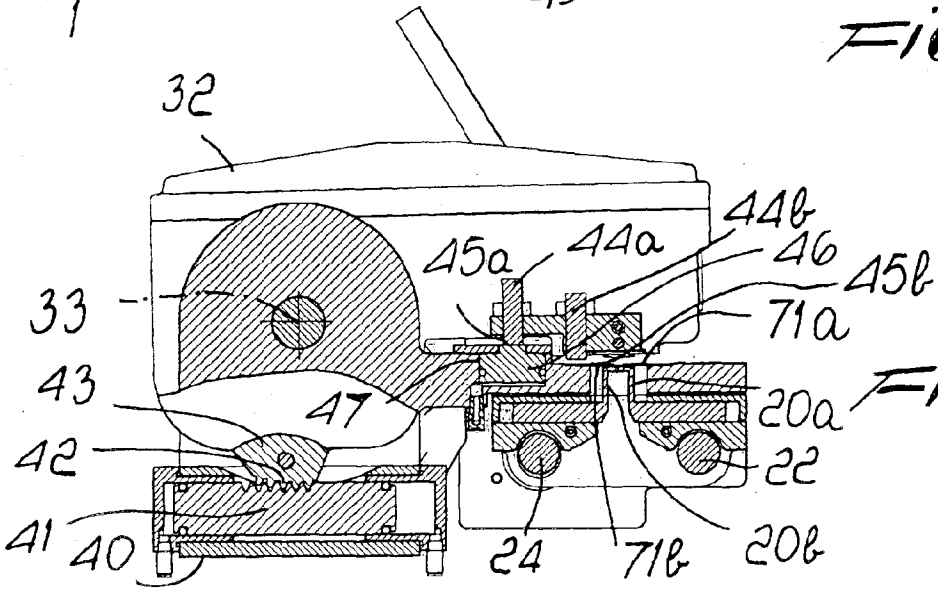
FIG. 12 is an enlarged-scale schematic sectional view of FIG. 3, taken along the line XII—XII.

The sewing head 14 is arranged in the first active position, since the shoulder 45*a* for the locator 44*a* is active, because the piston 46 is raised (FIG. 12).

Figure 4:
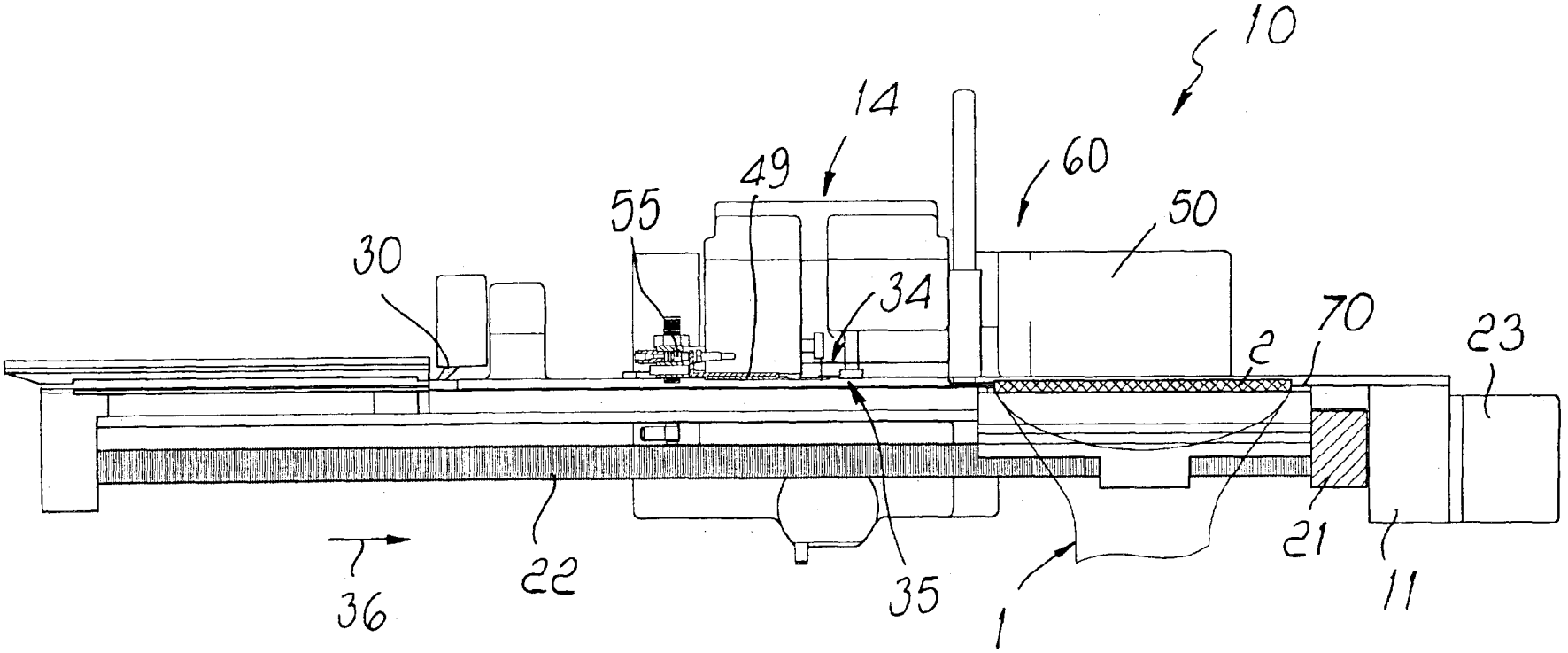

The article 1 then continues its advancement until it encounters the sewing head 14 and moves beyond it (FIG. 4). The intervention of the sewing head 14 on the article 1 produces a first sewing of the end of the article 1 with an overcast stitch. It should be noted that this sewing affects, i.e. is performed at the region of the article 1 that lies adjacent to the end formed by the cut produced by the trimming cutter 30, i.e., it affects the first, or in any case one of the first, rows of knitting of the actual hosiery item.

Once the hosiery item has moved past the sewing head 14 downstream, the excess chain stitches are cut by means of the chain-stitch cutter 60.

Figure 5:
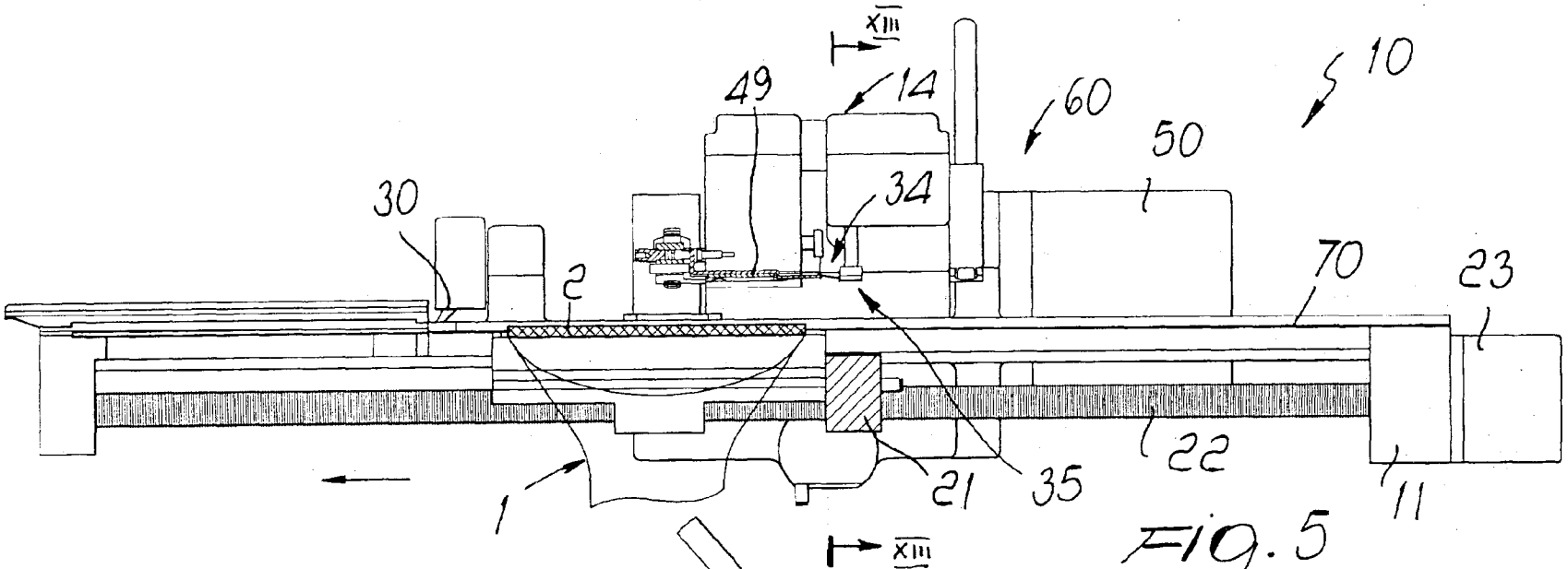
Figure 13:
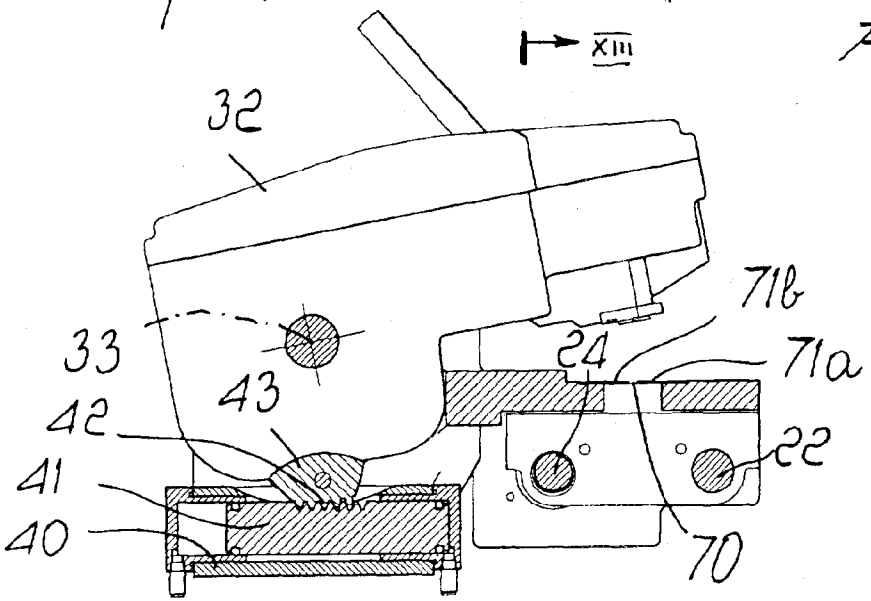
FIG. 13 is an enlarged-scale schematic sectional view of FIG. 5, taken along the line XIII—XIII.
Figure 6:
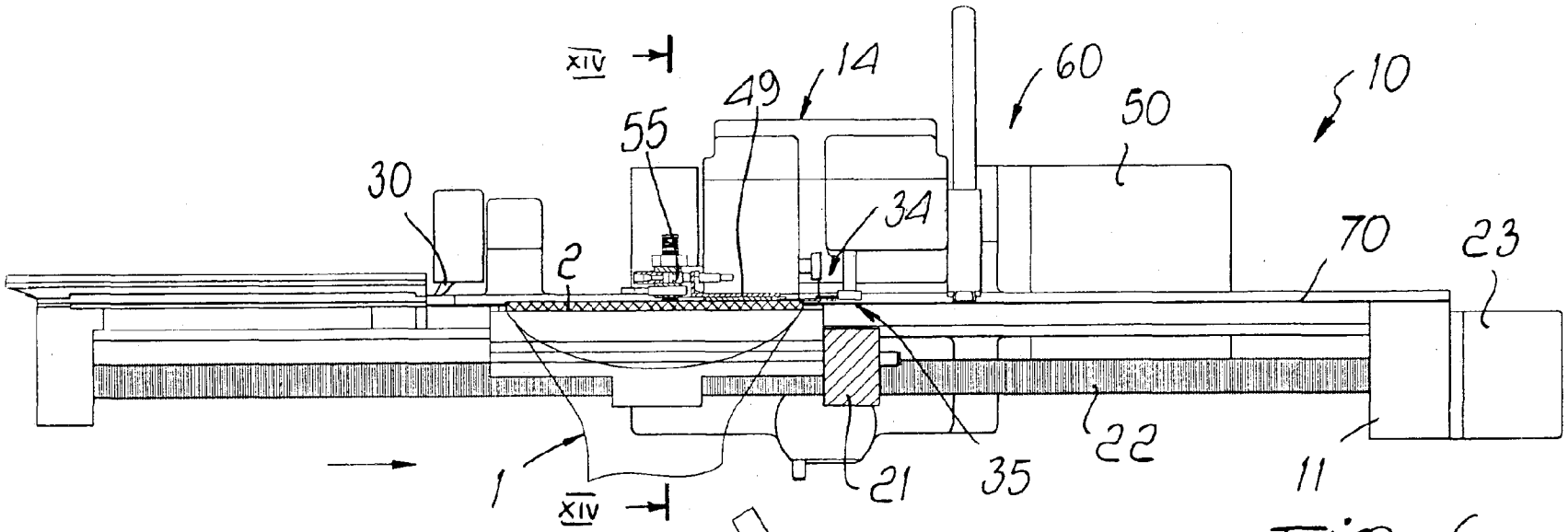
Figure 14:
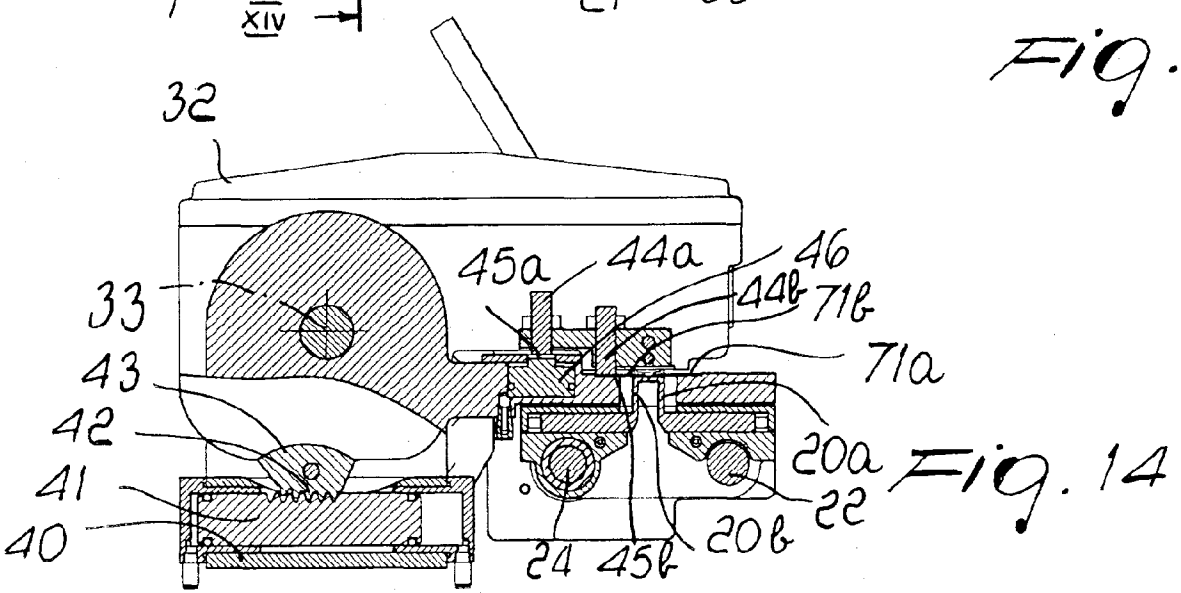
FIG. 14 is an enlarged-scale schematic sectional view of FIG. 6, taken along the line XIV—XIV.

Following to the actuation of the hydraulic or pneumatic cylinder 40, the sewing head 14 is moved into the inactive position, i.e., it is raised so as to not interfere with the article 1 (FIG. 13). Then the motor 23 is actuated, but with the opposite direction of rotation with respect to before, so as to cause the retraction of the article 1 until it is upstream of the sewing head 14 (FIG. 5). Then the shoulder 45*a* is deactivated, i.e., the piston 46 is lowered so that as a consequence of the actuation of the piston 41 of the hydraulic or pneumatic cylinder 40 in the opposite direction with respect to before, the sewing head 14 is lowered, resting with the locator 44*b* against the shoulder 45*b*, i.e., moving with the needle 34 and the crochet 35 to a sewing level that is preferably located below the level of the first stitched seam (FIGS. 6 and 14).

At this point, the actuation of the motor 23 is reversed again so as to cause the advancement of the hosiery item 1 toward the sewing head 14. As a consequence of this advancement and of the actuation of the needle 34 and of the crochet 35 of the sewing head 14, a second stitched seam is formed, again with an overcast stitch, but with a width of the stitches of the chain that is conveniently increased by acting on the hook 49.

After the article 1 has moved downstream past the sewing head 14 (FIG. 7), the sewing chain is cut by means of the chain-stitch cutter 60.

Figures 7, 15, 16:
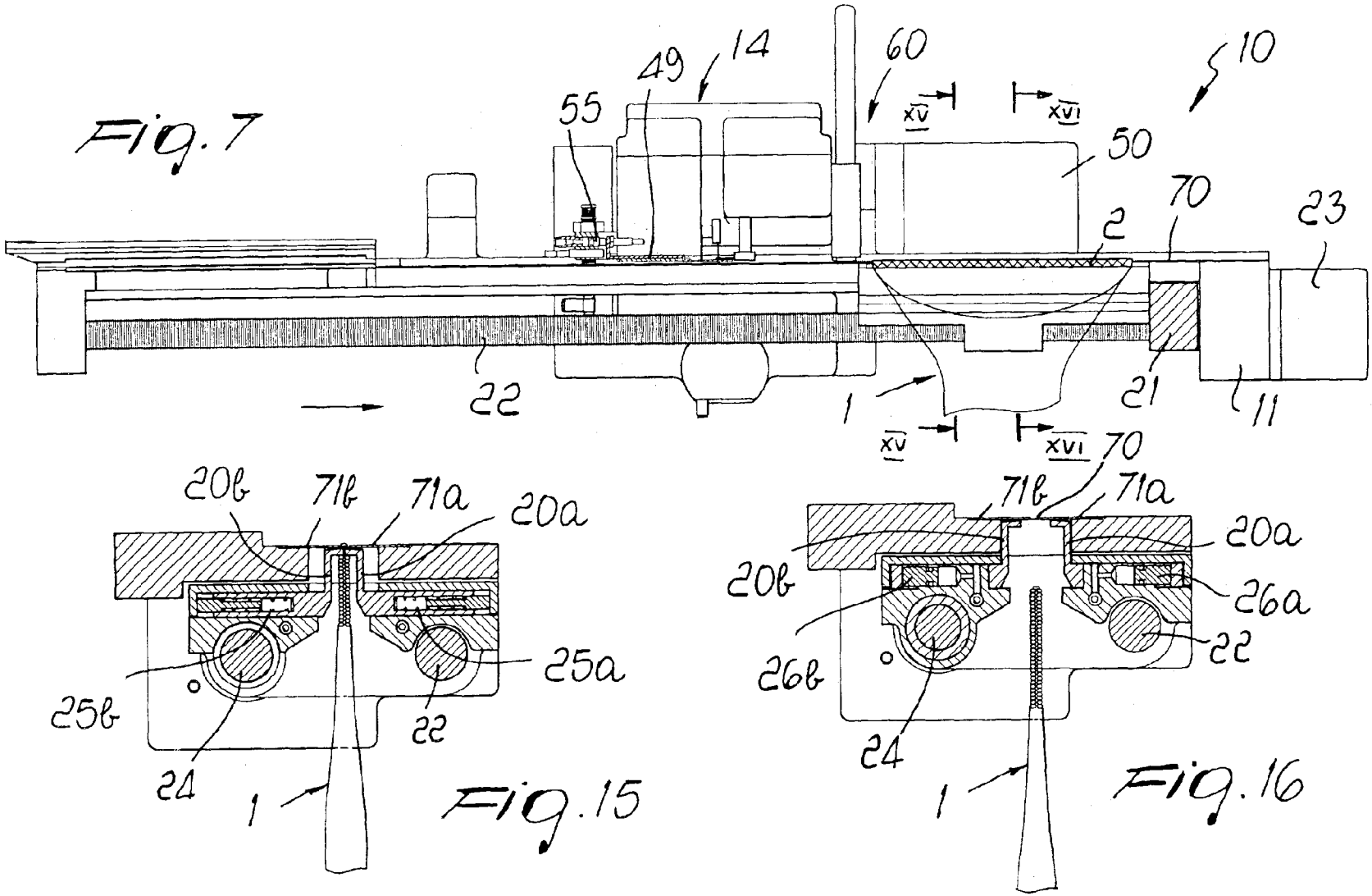
FIG. 15 is an enlarged-scale schematic sectional view of FIG. 7, taken along the line XV—XV.
FIG. 16 is an enlarged-scale schematic sectional view of FIG. 7, taken along the line XVI—XVI, illustrating the unloading of the article at the end of the sewing process.

At this point, the claws 20*a* and 20*b* are disengaged from the article 1, which is released and unloaded from the apparatus (FIG. 16).

At this point, the cycle resumes as already described so as to sew a second article, and so forth.

In practice it has been found that the method according to the invention fully achieves the intended aim, since by allowing to use a single sewing head to produce a double stitched seam for closing the toe of hosiery items or of the axial end of tubular articles in general it allows to provide a sewing apparatus that is structurally very simple and can be produced with very low costs and can therefore be used to serve a circular hosiery knitting machine so as to sew the articles that are produced by said machine in each instance.

The method and the apparatus thus conceived are susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2002A001736 from which this application claims priority are incorporated herein by reference.

What is claimed is:

1. A sewing method, for closing an axial end of a tubular article, comprising the steps of:

flattening an end of the article to be sewn by moving close to each other two opposite flaps of said end of the article;

inserting said end of the article between two mutually facing laminas that form a passage constituting at least an initial part of a guiding path for said end of the article, so that the article protrudes with a portion of said end from a side of said pair of laminas;

producing advancement of the article along said guiding path;

performing a first sewing of said end by way of a sewing head arranged proximate to said guiding path while the article advances along said guiding path;

disengaging the sewing head from the article and retracting the article along said guiding path until the article returns upstream of the sewing head;

again producing advancement of the article along said guiding path;

performing a second sewing of said end of the article by way of the same sewing head, while the article advances along said guiding path;

disengaging the article from the sewing head.

2. The method of claim 1, wherein during said second sewing step a second stitched seam is formed along a line that is spaced with respect to a line of a first stitched seam formed during the first sewing step.

3. The method of claim 2, wherein said first and second stitched seams are formed with overcast stitches.

4. The method of claim 3, wherein stitches of a chain of said first stitched seam are tighter than stitches of a chain of said second stitched seam.

5. The method of claim 4, wherein at an end of the first stitched seam and/or at an end of the second stitched seam, the chain of stitches is cut.

6. A sewing apparatus for closing an axial end of a tubular article, comprising: two mutually facing laminas that form a passage therebetween, said passage constituting at least an initial part of a guiding path and being adapted to receive a region of the article that is proximate to an end thereof to be sewn; at least one sewing head that faces a side of a plane of arrangement of said pair of laminas from which a portion of the end of the article to be sewn has to protrude; moving means for moving the article along said guiding path in two mutually opposite directions of motion in order to make the article advance with respect to the sewing head during formation of a first stitched seam, in order to make the article retract to a position upstream of the sewing head after forming the first stitched seam and make the article advance again during formation of a second stitched seam.

7. The apparatus of claim 6, comprising distance variation means for varying a distance of said sewing head from the plane of arrangement of said pair of laminas in order to vary position of a sewing line on the article.

8. The apparatus of claim 7, wherein said pair of laminas is arranged on a substantially horizontal plane in order to receive the article with the end thereof to be closed that protrudes upward from said laminas, said sewing head facing, in an upward region, the plane of arrangement of said laminas and being movable on command by action of said distance variation means along a direction that has a vertical component in order to be arranged at at least two different sewing levels.

9. The apparatus of claim 6, comprising, upstream of said sewing head along the advancement direction of the article during sewing, a trimming cutter for removing an excess part of said portion of the end of the article that protrudes upward from said laminas.

10. The apparatus of claim 8, further comprising a first motor for actuation of said sewing head and a second motor for the actuation of said moving means for moving the article with actuation speeds that are variable in order to vary tightness of the stitches.

11. The apparatus of claim 10, wherein said sewing head is a sewing head with a curved needle and a crochet adapted to perform overcast stitching.

12. The apparatus of claim 11, comprising a hook mechanism that is movable on command in order to vary width of the chain-stitches.

13. The apparatus of claim 8, comprising positioning means, provided above said laminas, for engaging said end of the article and move upward in order to apply to the article a tension that is orientated upward so as to place a beginning of the region of the article that is thicker against said contact surface, said laminas forming, with lower faces thereof, a contact surface for a region of the article that is proximate to the end to be closed and is thicker than a region of the article that is inserted between said laminas.

14. The apparatus of claim 8, wherein said moving means comprise claws, which are arranged on a side of said laminas that lies opposite the side said sewing head faces for engaging the two opposite sides of the article in a region of the article that is proximate to said laminas, said claws being movable on command along a direction that is parallel to an extension of said passage.

* * * * *